United States Patent [19]

Nadir et al.

[11] Patent Number: 4,701,759

[45] Date of Patent: Oct. 20, 1987

[54] CALL REMINDER FOR A RADIO PAGING DEVICE

[75] Inventors: Mark Nadir, Ft. Lauderdale; John D. Hauck, Plantation, both of Fla.

[73] Assignee: Motorola, Inc., Schaumburg, Ill.

[21] Appl. No.: 909,064

[22] Filed: Sep. 16, 1986

Related U.S. Application Data

[63] Continuation of Ser. No. 596,322, Apr. 3, 1984, abandoned.

[51] Int. Cl.[4] ..... G08B 3/00

[52] U.S. Cl. ..... 340/825.44; 340/825.45; 340/825.48

[58] Field of Search ..... 340/311.1, 328, 329, 340/825.44, 825.45–825.48; 179/2 EC

[56] References Cited

U.S. PATENT DOCUMENTS

| | | | |
|---|---|---|---|
| 3,283,315 | 11/1966 | Frear . | |
| 3,573,630 | 4/1971 | Baer | 340/311.1 |
| 4,072,903 | 2/1978 | Harris . | |
| 4,197,526 | 4/1980 | Levine et al. . | |
| 4,237,448 | 12/1980 | Weinberg . | |
| 4,249,165 | 2/1981 | Mori . | |
| 4,263,480 | 4/1981 | Levine . | |
| 4,323,881 | 4/1982 | Mori | 340/825.48 |
| 4,336,524 | 6/1982 | Levine . | |
| 4,356,519 | 10/1982 | Cogdell, Jr. . | |
| 4,385,295 | 5/1983 | Willard et al. . | |
| 4,398,192 | 8/1983 | Moore et al. . | |
| 4,419,668 | 12/1983 | Ganucheau | 340/825.44 |
| 4,477,807 | 10/1984 | Nakajima et al. | 340/825.48 X |

OTHER PUBLICATIONS

Silcom Memo Page I, "Tone and Visual Alert POCSAG Radiopager", Distributed by: FYI, Inc., 1984.

*Primary Examiner*—Ulysses Weldon

*Attorney, Agent, or Firm*—Mark P. Kahler; Joseph T. Downey; Anthony J. Sarli, Jr.

[57] ABSTRACT

An alerting device, such as a radio pager, which produces an audible alerting signal, in response to a unique identifier received and decoded by said device, incorporates circuitry for periodically reminding the user that a lagging signal has been received. In this context, a short alerting signal or call reminder alert occurs periodically upon cessation of the originating alert and/or message. This method of operation continues until the user manually discontinues it.

2 Claims, 2 Drawing Figures

CALL REMINDER FOR A RADIO PAGING DEVICE

This is a continuation of application Ser. No. 596,322, filed Apr. 3, 1984, now abandoned.

BACKGROUND OF THE INVENTION

1. Field of the Invention

The present invention relates to radio paging devices and more particularly to a radio paging receiver having a call reminder alert which periodically reminds the user that a paging signal has been received.

2. Description of the Prior Art

Radio paging devices are used in many applications to alert a user of a call. Such devices generally incorporate a radio receiver capable of producing an audible, alerting signal which can be heard by the user. Another type provides the additional feature of a voice message following the audible alert. These devices are referred to as tone only and as tone and voice pagers, respectively. To conserve battery life, many tone and voice pagers incorporate circuitry for limiting the length of both the alert tone signal and the voice message following the alerting signal. These paging receivers will electronically silence themselves after a specific period of time has succeeded the alert. Similarly, the tone only pagers will generally emit an alerting signal for only a limited period of time. Under these operating conditions, a user's pager might generate a paging alert, but the user may remain unaware of that alert because the paging device has electronically silenced itself. Thus, the user would never respond to the page. Two examples illustrative of the aforementioned situation are where the audible alert cannot be heard because of locally high ambient noise levels and where the user has momentarily left the paging device unattended.

To circumvent some of the above problems and to minimize the possibly disruptive effects of a paging alert at an inconvenient time or place, memory devices have been used to store a call which has been received so that an audible alert is not necessary. Such devices require the user to interrogate the pager memory at his convenience and, also, to initially place the paging device in the memory mode of operation. If the user can sufficiently anticipate where such circumstances may occur, the memory feature is desirable and the possibilty of a paging message eluding the user may be minimized. The memory feature, however, is particularly inconvenient if the user forgets that he has silenced the paging device by placing it in the memory mode and, additionally, the memory feature is ineffective if the circumstances which would cause an alerting signal to be overlooked are either transitory or unpredictable, or both.

A technique which has been utilized to effectively overcome these paging device limitations has been the use of a call light. A call light is often used in lieu of an alerting signal, or alternatively, in conjunction with the alert tone but remainson, or in a periodically flashing state, until the user discontinues it. Utilization of this feature requires that the paging device be in plain view of the user and that, like the memory feature, it be consciously checked by the user. With the paging device inside an article of clothing or on the waist this may not be a convenient operation. Furthermore, the high current drain of the alert light, which often flashes once a second, is not consistent with goals for maximizing the battery life.

SUMMARY OF THE INVENTION

Accordingly, one objective of this invention is to provide a novel paging device which produces an initial audible alert upon the receipt of a paging signal and periodically thereafter reminds the user that a page has been received.

It is a further objective of this invention to provide a paging device having an audible alert which occurs frequently enough to remind the user of an unacknowledged paging message, without conscious intervention by the user, and infrequently enough not to substantially, negatively impact battery life.

It is another object of this invention to provide a paging device which allows the user thereof to acknowledge the receipt of a paging message by actuating a reset button on the paging device which will cancel the call reminder feature.

In order to accomplish the aforementioned objectives, circuitry is provided in the radio paging device which periodically reminds the user that a paging signal has been received. In the preferred embodiment, after the cessation of an audible alerting signal produced by the radio device in response to a unique identifier received and decoded by the paging device, a short alert signal is periodically generated to remind the user that a call has been received.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
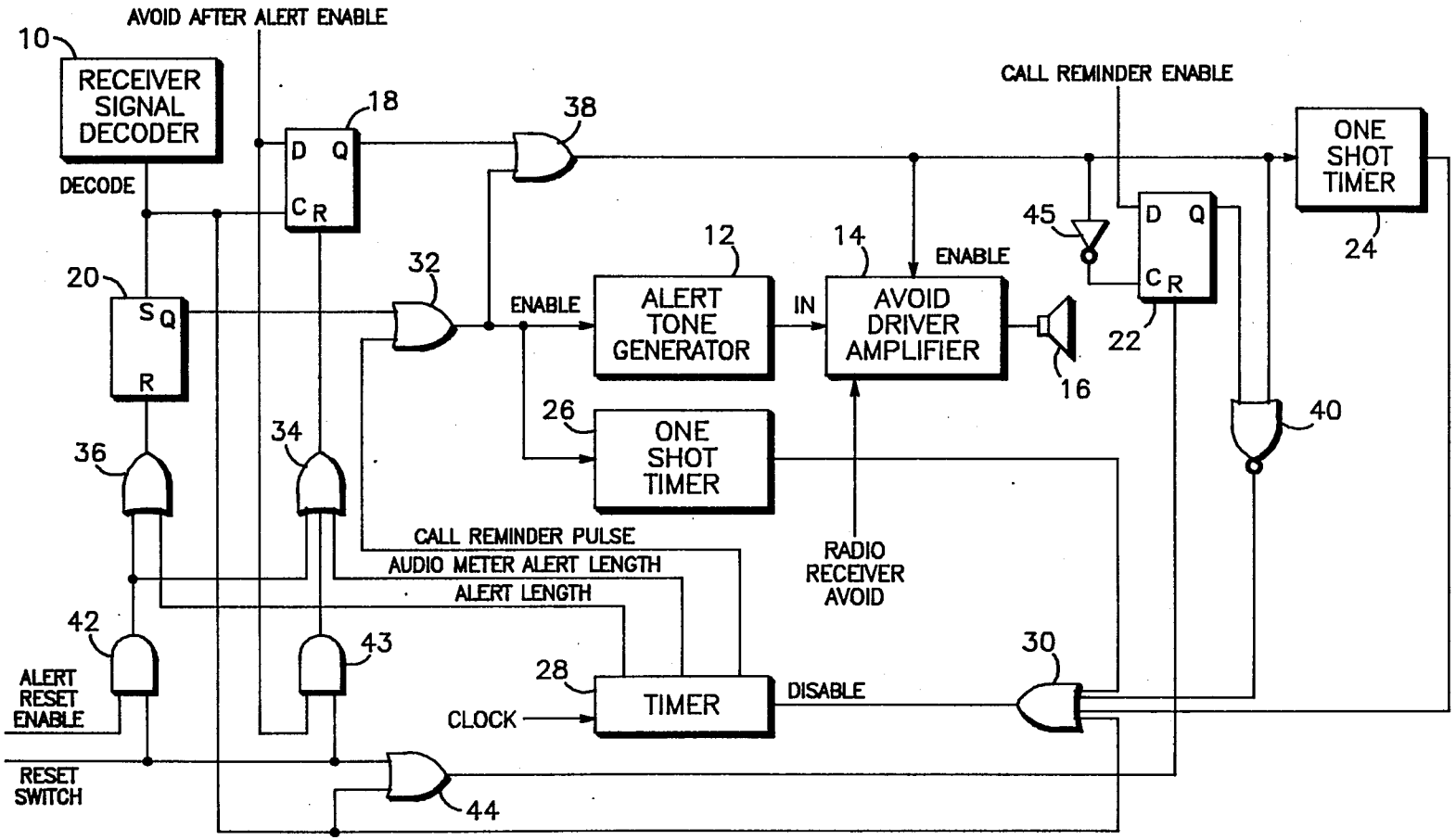
FIG. 1 is a block diagram of the present invention.

Referring now to the drawings, wherein like reference numerals designate identical or corresponding parts throughout the several views, and more particularly to FIG. 1 thereof, a circuit diagram of a radio paging device embodying the present invention is illustrated. The radio paging device includes a radio receiver and signal decoder 10 which may operate at a radio frequency in a range of frequencies used for this purpose. The receiver and signal decoder 10 is responsive to a code unique to the particular paging device. The coded paging signal can be of any known type such as the commonly used tone or binary formats. Alternatively, the decoder 10 can be responsive to a code shared among several paging devices, all of which respond to that particular code or a specified subset thereof. The paging device also includes an alert tone generator or oscillator 12 which produces an alternating tone signal in the audio frequency range. The signal produced by alert tone generator 12 is applied to an audio driving amplifier 14 and then to audio transducer 16, which can be a loudspeaker. The alert tone generator 12 and audio amplifier 14 are of known construction and, generally, the design of the amplifier is such that the receiver audio is muted while the alert tone generator 12 is operative.

The receiver and signal decoder 10 can be made responsive to a single unique identifier selected from a large number of possible paging identifiers. Most commonly, the selection of a single unique paging code determines to which code, or code subset, the pager may respond and precludes response to any other identifiers. To facilitate this selection, a programmable codeplug (not shown), well known to those skilled in the art, is often used to configure the decoder 10 operation following the receipt of the selected paging signal. The paging signal sent to the pager is generally comprised of the unique paging identifier often, depending on the paging format, followed by digital or voice data. The decoder 10 is of known construction and operates in a manner commonly utilized in radio paging devices. It is common, however, for the decoder to be of the large scale integrated (LSI) circuit type and for the decoder to be configurable in a multitude of operating modes by programming from the same codeplug which selects the paging identifier. This allows a multifaceted decoder to be designed which may incorporate a large number of features which are both user convenient and necessary to encompass the many different paging systems, environments and formats currently in operation. The aspects of decoder programmability are well known to those skilled in the paging art.

FIG. 1 also shows the logic devices necessary to implement the call reminder feature. There are three inputs to the logic which define the pager operation following the receipt of a valid paging signal. These inputs may be supplied from a codeplug if this circuitry is incorporated within the LSI decoder or are otherwise supplied in accordance with the desired operational performance of the pager.

The first input is the ALERT RESET ENABLE which allows the alerting signal to be manually reset by the reset switch of the paging device (not shown) when it is at a high logic level. The reset switch input shown in FIG. 1 is only at a high logic level when the reset switch is activated. If received audio following the alerting signal is desired, as would be the case with a tone and voice pager, then the AUDIO AFTER ALERT ENABLE input as selected by the codeplug must be at a high logic level. The third input is the CALL REMINDER ENABLE as selected by the codeplug must be at a high logic level if the feature is desired.

The operation of the call reminder feature for a tone and voice paging device with resettable alert tones will be described hereafter. For this case all the option inputs, ALERT RESET ENABLE, AUDIO AFTER ALERT ENABLE and CALL REMINDER ENABLE are at high logic levels. It is further initially assumed that the paging device is currently enabled and is ready to receive a paging signal. Under these conditions, flip-flops 18, 20 and 22 are initially reset with their respective Q outputs at low logic levels. The respective outputs from the digital one-shot timers 24 and 26 are always at low logic levels unless triggered by a falling edge input. When triggered, the one-shot timers 24 and 26 will output a high logic level pulse for a short period of time, for instance 20 uS. The timer 28 is enabled by a low logic level input from OR gate 30 and, when enabled, generates high logic level outputs to OR gates 32, 34 and 36 at specified periods of time. When disabled, the timer 28 outputs are always at a low logic level.

Figure 2:
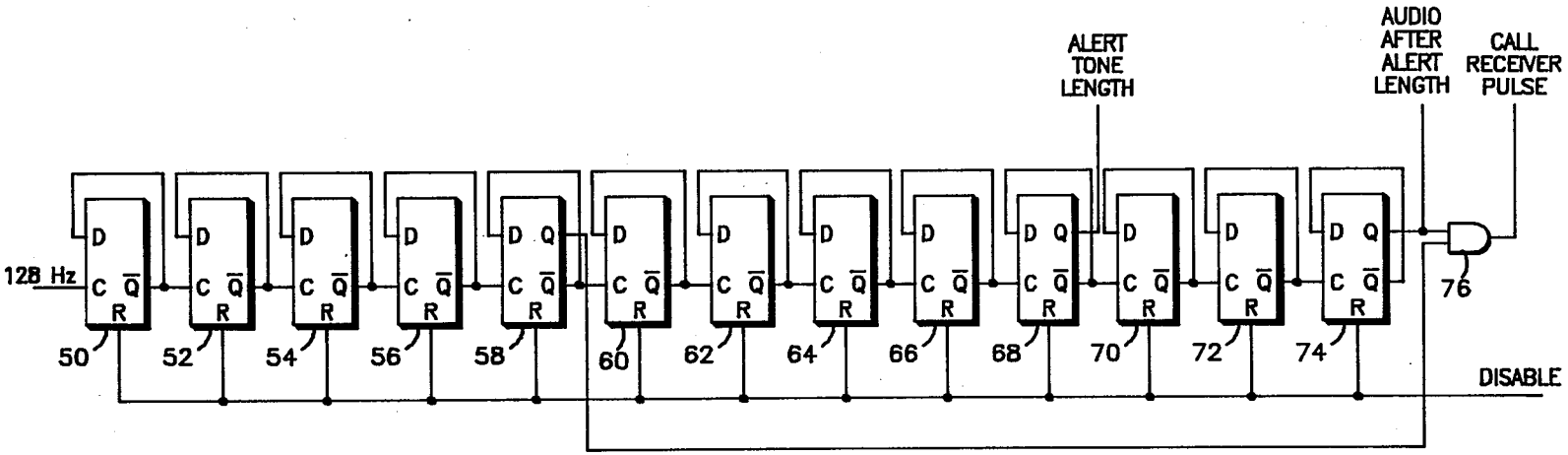
FIG. 2 is a schematic diagram of the timer of FIG. 1.

Respective outputs from the timer 28 control the alert length, the period of time audio will be permitted following the alerting signal and when the call reminder pulse will occur. In this embodiment, the alert length output will occur first. If the timer is not reset, the next output will be the audio after alert period, finally followed by the call reminder pulse. FIG. 2 shows that the timer 28 is essentially a ripple counter reset by OR gate 30. It should be obvious to those skilled in the art that the logic of FIGS. 1 and 2 may be modified in such a manner that the output durations of the previously mentioned events can occur in any desired order.

With the pager ready to receive a paging message the output from OR gate 32 is at a low logic level and the alert tone generator 12 is disabled. The output from OR gate 38 is also at a low logic level which consequently disables the audio amplifier 14. Since the D flip-flop 22 has not been clocked, the output from OR gate 38 causes a high logic level output from NOR gate 40 which disables the timer 28 through the OR gate 30. Thus the pager remains silent while awaiting receipt of the specified paging signal.

When a valid paging signal has been received, the decoder 10 will output a high logic level pulse for a short duration, for instance 1 mS. This will set RS flip-flop 20 and clock D flip-flop 18 to a high logic level state. The resulting high logic level output from OR gate 32 enables the alert tone generator 12 and the audible alert is heard by the user through audio transducer 16 driven by amplifier 14 which has been enabled via OR gate 38. The high logic level output from OR gate 38 causes a low logic level output from the NOR gate 40 and the disabling signal from the OR gate 30 is removed from timer 28. The alerting signal will continue until the output from OR gate 32 changes to a low logic level. This can occur in two ways. First, actuation of the reset switch by the user will cause the RS latch 20 to reset via AND gate 42 and OR gate 36. Activation of the reset switch will also reset the flip-flop 18 via AND gate 43 and OR gate 34 thereby silencing the audible alert and any audio which might follow. Secondly, a high logic level output from timer 28 will cause OR gate 36 to reset RS latch 20. Therefore, if the user does not manually reset the alerting signal the timer 28 will automatically discontinue it at a preselected time.

Assuming that the user does not manually shorten the alerting signal, the falling edge output from OR gate 32 will disable the alert tone generator 12 and trigger a momentary output from one-shot timer 26. The audible alert tone ceases, but then audio amplifier 14 remains enabled since D flip-flop 18 is not reset by OR gate 34 unless the reset switch is manually activated. The output period of the one-shot timer 26 needs only to be long enough to reset the timer 28 via OR gate 30. Once the momentary reset of timer 28 is complete, the timer 28 will begin timing again. Since timer 28 is basically a ripple counter the outputs are sequential. The first output from the timer occurs at the time designated as the alert length time but cannot reset D flip-flop 20 which has previously been reset. The next timer output occurs at the time designated as the period permitted for an audio message following the alerting signal and causes OR gate 34 to reset D flip-flop 18 and disable audio amplifier 14.

After the radio paging device generates an alert signal for a first preselected period of time, it allows the paging device audio to remain on for a second preselected period of time following the alerting signal so that a user may hear a voice message. The falling edge output from OR gate 38, which disables the pager audio, triggers a momentary output from one-shot timer 24 causing timer 28 to be reset via OR gate 30. The falling edge output from OR gate 38, via the inverter 45, also clocks the output of the D flip-flop 32 to a high logic level state. This will keep the timer 28 enabled via NOR gate 40 and OR gate 30 unless a momentary output from one of the one-shot timers 24 or 26 resets it. With timer 28 reset by one-shot timer 24 the first two preselected time periods will pass but will not change the states of either the D flop-flop 18 or RS latch 20 which have both been previously reset. The third timer output which is the call reminder pulse then occurs and remains in a high logic level state for a short time duration. This period of time is the amount of time the call reminder alert will last and is typically about 125 mS. While the call reminder pulse is present as an output from timer 28, the alert tone generator 12 is enabled by OR gate 32 which subsequently enables the audio amplifier 14 via OR gate 38. The opposite is true when the pulse returns to a low logic level state which then triggers the one-shot timer 24 for a momentary length of time and restarts the sequence just described. The timer 28 will only be disabled momentarily (reset) so long as D flip-flop 22 remains set. Thus this third preselected time period will elapse again and the call reminder alert will repeat until D flip-flop 22 is reset by OR gate 44. This condition only occurs when the user manually resets, or acknowledges, the call reminder feature or if a subsequent paging signal is decoded by the pager.

In summary, the sequence of events is as follows. First the paging device receives a paging signal and in response generates an alerting signal which may be manually shortened. If not manually shortened, the alerting signal will automatically cease after the first preselected period of time. Following the alert signal the audio amplifier 14 will remain on for the second preselected period of time (greater the the first period) to allow reception of a voice message, unless manually reset by the user. At the conclusion of the audio message a third preselected period of time (greater than the first two) will elapse and a call reminder alert signal will occur for a fourth preselected period of time. This last sequence will repeat until the user, presumably hearing the reminder alert and realizing that a message has been missed, manually resets the feature.

Alternatively, if a subsequent paging signal is decoded while the call reminder feature is operative the decoder 10 output will reset the timer 28 via OR gate 30 and D flip-flop 22 via OR gate 44 and the entire sequence will begin again.

If some of the option inputs had been different the operation of the logic in FIG. 1 would be modified accordingly. For instance, if the ALERT RESET ENABLE had not been set, actuation of the reset switch could not shorten the alert signal. Also, if the AUDIO AFTER ALERT ENABLE had not been selected, D flip-flop 18 could never be set and receiver audio would not follow the alert signal. Similarly, if the CALL REMINDER ENABLE had not been selected, the D flip-flop 22 could never be set and the timer could never run for a period of time sufficient to initiate the call reminder alert.

Referring now to FIG. 2, one embodiment of a circuit which may be used for timer 28 is illustrated. The timer 28 is a binary ripple counter but may be any timer of known design which is capable of providing outputs at a multitude of designated periods of time. The timer demonstrated can occupy any one of a possible 8192 states. Different outputs, or taps, provide the periods previously designated as the alert tone length, the audio after alert length, and the call reminder pulse. The timer of FIG. 2 is of known construction using 13 D flip-flops 50 to 74 which can all be held reset, thereby placing the counter in the zero state and disabling it. Under such circumstances, the clocking signal at the input of D flip-flop 50 cannot change the state of the device and the counter cannot increment. When the disabling input is removed the counter may count up, in steps of the input clock period, to state 8192. Any input on the disabling input will reset the counter to the zero state and remove any memory of any prior state the counter may have occupied. As the counter increments, its design is such that the two outputs designated as the alert tone length from D flip-flop 68, and audio after alert length from D flip-flop 74, first change to high logic levels at states 512 and 4096, respectively. The output designated as the call reminder pulse will change to a high logic level at state 4112 and remain high for 16 cycles of the input clock.

The timer 28 shown in FIG. 2, when clocked by a 128 HZ clocking signal, allows the paging device to have a 4 second alert followed by 32 seconds of audio followed by a first, and subsequent call reminder 'beeps' every 32.125 seconds for a duration of 125 mS.

Obviously, numerous (additional) modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A receiver of the type which generates an alerting signal to apprise a user that said receiver has been addressed, comprising:

receiver-decoder means for receiving an encoded address signal, decoding said encoded address signal and detecting if said receiver has been addressed;

initial alert signal generating means, coupled to said receiver-decoder means, for generating a periodic initial alert signal when the address of said receiver is detected, said initial alert signal being generated during a first period of time and reminder audio alert signal generating means, coupled to said receiver-decoder means, for generating a periodic reminder audio alert signal commencing when a predetermined amount of time has elapsed after the cessation of said initial alert signal, said remidner alert signal being periodic at a different rate than said initial alert signal.

2. A receiver of the type which generates an alerting signal to apprise a user that said receiver has been addressed, comprising:

receiver-decoder means for receiving an encoded address signal, decoding said encoded address signal, and detecting if said receiver has been addressed;

initial alert signal generating means, coupled to said receiver-decoder means, for generating an initial alert signal when the address of said receiver is detected, said initial alert signal being generated during a first period of time, said initial alert signal including a plurality of audio bursts during a first predetermined period of time, the occurrence of said bursts being periodic at a first predetermined rate; and reminder audio alert signal generating means, coupled to said receiver-decoder means, for generating a reminder audio alert signal including a plurality of audio bursts, the occurrence of the audio alert signal including a plurality of audio bursts, the occurrence of the audio bursts of said reminder alert signal commencing when a predetermined amunt of time has elapsed after the cessation of said initial alert signal, and being periodic at a second predetermined rate substantially less than said first predetermined rate.

* * * * *